US007712279B2

(12) United States Patent
McClure

(10) Patent No.: US 7,712,279 B2
(45) Date of Patent: May 11, 2010

(54) KNOCK-DOWN ROOF CURB

(75) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 11/563,513

(22) Filed: Nov. 27, 2006

(65) Prior Publication Data

US 2007/0094984 A1 May 3, 2007

Related U.S. Application Data

(63) Continuation of application No. 10/944,714, filed on Sep. 21, 2004, now abandoned.

(51) Int. Cl.
*E04C 3/00* (2006.01)

(52) U.S. Cl. ..... 52/580; 52/64; 52/200

(58) Field of Classification Search ..... 52/64, 52/580, 67, 200
See application file for complete search history.

(56) References Cited

U.S. PATENT DOCUMENTS

| | | | | |
|---|---|---|---|---|
| 3,521,414 | A | 7/1970 | Malissa | |
| 3,742,659 | A * | 7/1973 | Drew | 52/19 |
| 3,802,131 | A | 4/1974 | Resech | |
| 3,807,110 | A | 4/1974 | Kaminski | |
| 3,812,634 | A | 5/1974 | Resech | |
| 3,838,544 | A | 10/1974 | Hindall | |
| 4,193,237 | A | 3/1980 | Jankowski | |
| 4,428,166 | A | 1/1984 | Burghart | |
| 4,470,230 | A | 9/1984 | Weisner | |
| 4,559,753 | A | 12/1985 | Brueske | |
| 4,603,517 | A | 8/1986 | Lyons, Jr. | |
| 4,860,511 | A | 8/1989 | Weisner et al. | |
| 4,887,399 | A | 12/1989 | Berger et al. | |
| 4,895,066 | A * | 1/1990 | Carnahan | 454/275 |
| 4,917,345 | A | 4/1990 | Czech | |
| 5,016,406 | A | 5/1991 | Calam et al. | |
| 5,419,090 | A | 5/1995 | Sandow | |
| 5,465,533 | A | 11/1995 | Rummo, Jr. et al. | |
| 5,647,175 | A | 7/1997 | Smyth | |
| 5,675,940 | A | 10/1997 | Bahar et al. | |
| 5,682,713 | A | 11/1997 | Weiss | |
| 5,687,514 | A | 11/1997 | Gillispie | |
| 5,718,088 | A | 2/1998 | Jacobsen | |
| 5,791,092 | A | 8/1998 | Strieter | |
| 5,832,674 | A | 11/1998 | Ledbetter et al. | |
| 5,896,711 | A | 4/1999 | McClure | |

(Continued)

OTHER PUBLICATIONS

International Search Report dated Jan. 19, 2007 in related PCT Patent Application Publication No. WO 2007/011561.

(Continued)

*Primary Examiner*—Basil Katcheves
(74) *Attorney, Agent, or Firm*—Lathrop & Gage LLP

(57) ABSTRACT

A roof curb is shipped in a disassembled state to an installer who assembles, sizes, locates and configures the curb to accommodate slope on any roof without welding or metal cutting. The curb includes an aluminum walls, each having a channel for receiving the bottom edge of a board, which may be taper cut according to the pitch of the roof to provide a level surface for supporting an appliance. Methods of making and installing the roof curb also are disclosed.

17 Claims, 11 Drawing Sheets

U.S. PATENT DOCUMENTS

| | | | |
|---|---|---|---|
| 6,041,557 | A | 3/2000 | Brown et al. |
| 6,044,592 | A | 4/2000 | Strieter |
| 6,067,759 | A | 5/2000 | House |
| 6,151,838 | A | 11/2000 | Husein |
| 6,343,439 | B1 | 2/2002 | Rutledge |
| 6,354,046 | B1 | 3/2002 | Swearingen |
| 6,494,007 | B1 | 12/2002 | Gembala |
| 7,043,882 | B2 | 5/2006 | Gumpert et al. |
| 7,134,254 | B1 | 11/2006 | Van Gelder |
| 2002/0139063 | A1 | 10/2002 | Crane |

OTHER PUBLICATIONS

Related PCT Application Publication No. WO 2007/011561 dated Jan. 25, 2007.

Relevant File History of related U.S. Appl. No. 10/944,714.

Office Action dated Nov. 15, 2005 issued in related U.S. Appl. No. 10/944,714.

Response to Office Action dated Nov. 15, 2005 issued in related U.S. Appl. No. 10/944,714, filed Feb. 2, 2006.

Office Action dated May 25, 2006 issued in related U.S. Appl. No. 10/944,714.

Response to Office Action Dated May 25, 2006 issued in related U.S. Appl. No. 10/944,714, filed Aug. 25, 2006.

Advisory Action dated Sep. 5, 2006 issued in related U.S. Appl. No. 10/944,714.

Notice of Abandonment dated Apr. 6, 2007.

Written Opinion dated Sep. 6, 2007 issued in related PCT Patent Application Serial No. PCT/US06/26628.

* cited by examiner

STEP 31: CUTTING BOTTOM EXTRUSION

STEP 32: CUTTING EXTRUSIONS

STEP 30: DETERMINE CURB SIZE

STEP 35: APPLY CORNER BLOCK MASTIC

STEP 34: DRILL CORNER CONNECTION

STEP 36: CUTTING TREX. BOARD

STEP 37: DETERMINE TREX. BOARD DIMENSIONS

STEP 33: CUTTING STEEL CHANNELS

STEP 38: ASSEMBLE EXTRUSION CORNERS

STEP 5.5 CUTTING BOTTOM EXTRUSION

STEP 5.0 CUTTING EXTRUSIONS

STEP 5.5 DETERMINE CURB SIZE

STEP 5.6 APPLY CORNER BLOCK MASTIC

STEP 5.15 DRILL CORNER CONNECTION

STEP 5.23 CUTTING DIVERTER PLATE

STEP 5.20 CUTTING STEEL CHANNELS

STEP 5.15 CUTTING TREX BOARD

STEP 5.10 DETERMINE TREX BOARD DIMENSIONS

STEP 5.35 ASSEMBLE EXTRUSION CORNERS

STEP 605 MARKING ROOF FOR CUTOUT

STEP 607 COMPLETE MARKING FOR DIVERTER PLATE

STEP 620 INSTALL SIDE SUPPORT CHANNELS

STEP 615 PANEL CUTOUT

STEP 625 INSTALL REAR SUPPORT CHANNEL

KNOCK-DOWN ROOF CURB

This application is a continuation of copending application Ser. No. 10/944,714, filed Sep. 21, 2004.

BACKGROUND OF THE INVENTION

Metal buildings having metal roofing have become popular for commercial, industrial and warehousing uses. These buildings often require roof openings for skylights, fans, air conditioning units and the like. The installation of such equipment requires a roof curb for support.

Traditionally, roof curbs have been designed specifically and custom made to provide a relatively horizontal mounting structure for a particular rooftop appliance given the shape and pitch of a particular roof. Designing and building these traditional roof curbs, often formed from a singular piece of metal to uniquely accommodate a particular roof pitch, has been a laborious and time consuming task for roof curb manufacturers and rooftop appliance installers. Further, because these roof curbs are installed in a metal roof system, the actual opening may vary with respect to the roof corrugations, seams or ribs, which may be ascertainable only shortly before installation. This untimely design-and-build practice delays appliance installation.

Manufacturers developed standardized roof curbs to help limit installation delays. See, for example, U.S. Pat. No. 4,559,753, issued Dec. 24, 1985, to Ralph H. Brueske, for Method of Installing a Prefabricated Curb Unit to a Standing Seam Roof, which describes a method of installing a metal roof curb in which the rims of the curbs are pre-welded to a roof panel, and the curb containing-panel is attached to a large opening cut into the roof. However, this method requires cutting a hole in the roof that is larger than the opening for the equipment that may be susceptible to leakage.

Prefabricated roof curbs tend to be quite large, thus have been difficult to ship in a cost effective and timely fashion, let alone by traditional rapid delivery methods. Consequently, roof curb manufacturers have had to ship their products by truck, which is slower and more expensive.

Traditional roof curbs include four coated steel curb walls positioned to define an open rectangular frame joined by factory welding at the corners. Because welding burns off the corrosion resistant coating of the steel, the manufacturer or installer must provide an additional coating of rust inhibitor paint to keep the roof curb from rusting when installed on the roof. Routine rust inhibitor paint coatings are required to protect the roof curb throughout the life of the product. Mechanical attachment, such as with threaded fasteners, may secure the corners without welding. However, on-site sizing and drilling of traditional roof curb panels creates exposure to corrosive weathering.

What is needed is a standardized, corrosion-resistant roof curb that can be shipped in a disassembled state, which an installer may assemble, size, locate and configure to provide an appropriate roof slope on any roof without welding.

SUMMARY OF THE INVENTION

The invention is a standardized, corrosion-resistant roof curb that can be shipped in a disassembled state, which an installer may assemble, size, locate and configure to provide an appropriate roof slope on any roof without welding.

The invention provides improved elements and arrangements thereof, for the purposes described, which are inexpensive, dependable and effective in accomplishing intended purposes of the invention.

Other features and advantages of the invention will become apparent from the following description of the preferred embodiments which refers to the accompanying drawings.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENTS

Figure 1:
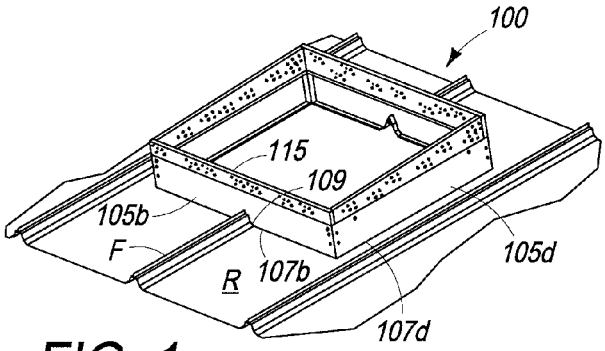
FIG. 1 is an environmental perspective view of an embodiment constructed according to principles of the invention.
Figure 3:
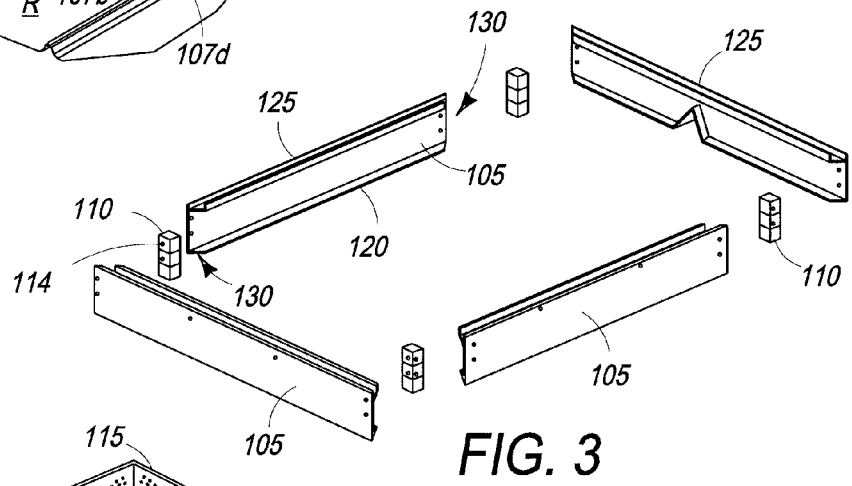
FIG. 3 is an environmental perspective view of a portion of the embodiment of FIG. 1.
Figure 2:
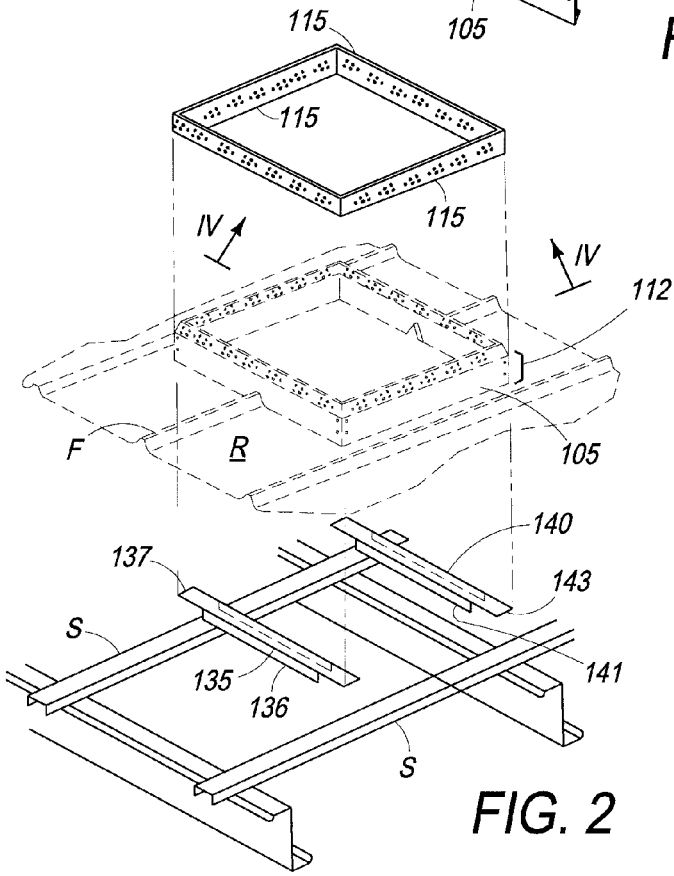
FIG. 2 is an exploded environmental perspective view of the embodiment of FIG. 1.

Referring to FIGS. 1-3, an embodiment of a roof curb 100 configured according to the invention includes four walls 105 interconnected with four connection blocks 110, defining a roof curb base 112, for mounting on a roof R. Four composite boards 115 mount on walls 105 and support an appliance (not shown).

In practice, walls 105 are cut into standardized lengths that foster ready packaging in standard shipping containers along with other components described herein for conventional or overnight courier delivery. Aluminum extrusion stock permits on-site sizing of the standard pieces without local burning off of corrosion resistant coatings ordinarily required for steel stock. Using aluminum stock also eliminates routine rust inhibitor paint coatings that would be required to protect steel stock.

Figure 4:
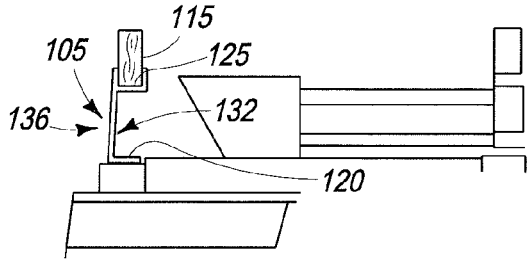
FIG. 4 is a cross-sectional detail view drawn along line IV-IV in FIG. 2.

Referring also to FIG. 4, each wall 105 is constructed of extruded aluminum having a lower flange 120 and an upper channel 125. Each flange 120 is inwardly-disposed to limit exposure of fasteners and other mounting mechanisms and sealing to the elements. Each flange 120 has chamfered ends 130 that promote flushness along the entire contacting surface of flange 120 with roof R.

Each channel 125 is configured to receive and retain a composite board 115. Channels 125 are inwardly disposed so as to define, in conjunction with wall 105, a generally uniform vertical wall 127 without ledges or partial enclosures that might find favor with unwanted insects and vermin.

Flange 120, vertical wall 127 and channel 125 define a pocket 128 for receiving insulation, as described below.

Side walls 105*a* have an edge 107*a* that provides a continuous, water-tight seal with roof R. Top and bottom walls 105*b* have notches 109 for alignment with and accommodation of seams or ribs F extending from roof R, thus defining an edge 107*b* that also provides a continuous, water-tight seal with roof R.

Figure 8:
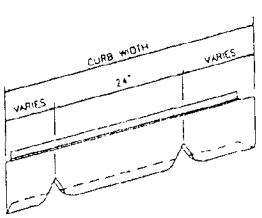
FIG. 8 is a schematic representation of the embodiment of FIG. 7.
Figure 8:
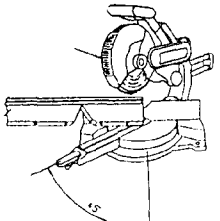
Figure 8:
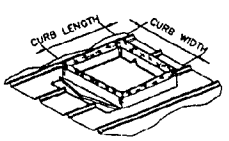
Figure 8:
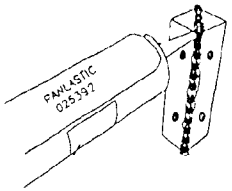
Figure 8:
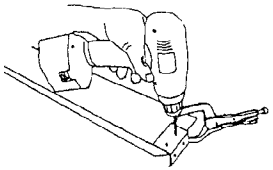
Figure 8:
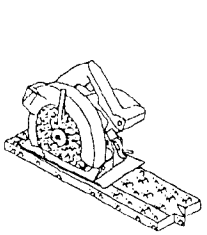
Figure 8:
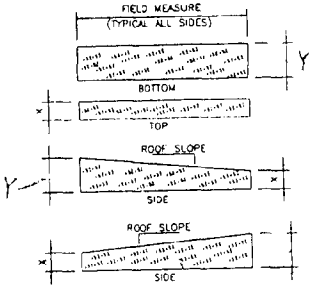
Figure 8:
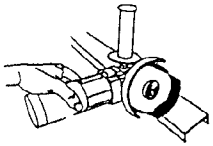
Figure 8:
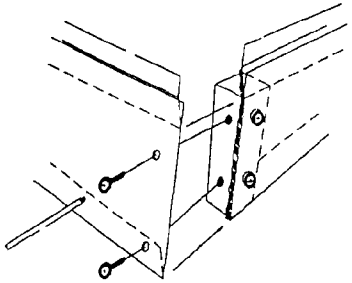

Referring to FIG. 3, each connection block 110 is constructed from aluminum and has pre-drilled through bores 114 at predetermined locations. In practice, a roof curb installer introduces holes at the ends of walls 105 according to a template, as shown in FIG. 8, that register with through bores 114.

Preferably, composite boards 115 are Trex® boards, which are constructed from a combination of reclaimed wood and plastic. The plastic component shields the wood component from moisture and insect damage, reducing or eliminating rotting or splintering. The wood component protects the plastic component from ultraviolet radiation damage from ordinary sunlight, ensuring integrity longer than would be expected from products constructed from purely plastic or purely wood.

Figure 6:
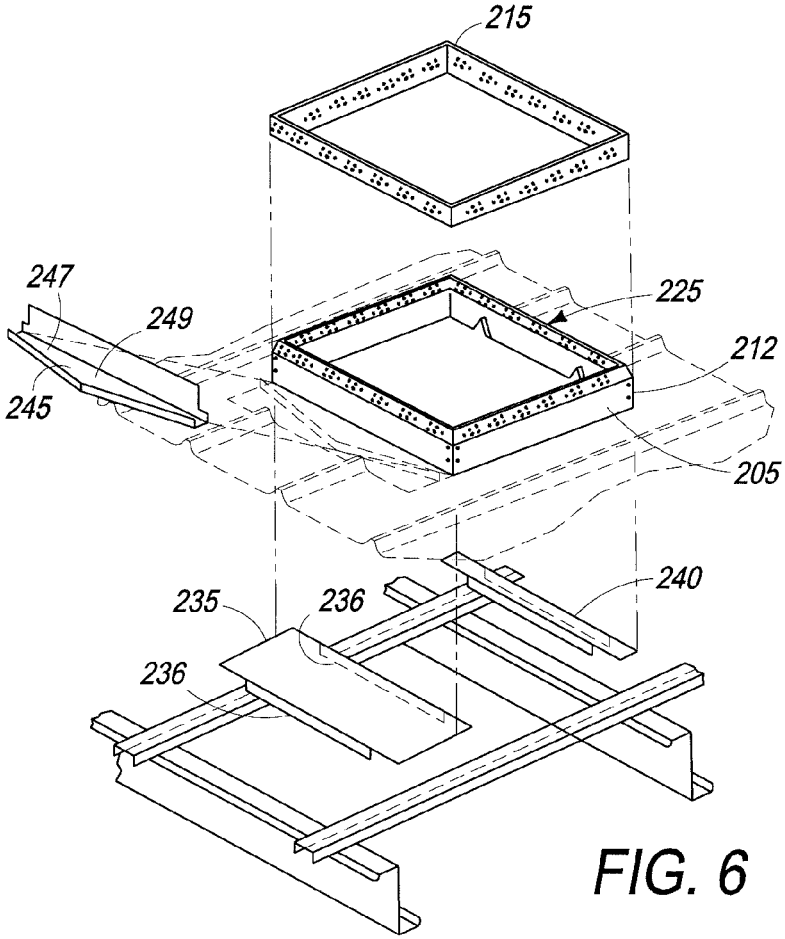
FIG. 6 is an exploded environmental perspective view of the embodiment of FIG. 5.

As shown in FIG. 2, unique to roof curb 100 is a top support channel 135. Top support channel 135 is similar to bottom support channel 140, which is common to roof curb 100 and roof curb 200, as shown in FIG. 6. Top support channel 135 and bottom support channel 140 each have generally perpendicular ribs 136 and 141, respectively. Ribs 136, 141 strengthen and enhance top support channel 135 and bottom support channel 140 load bearing capabilities.

Top support channel 135 has flanges 137 and bottom support channel 140 has flanges 143 that mount onto structural members S supporting roof R. When installed, top support channel 135 and bottom support channel 140 each support a wall 105*b*, and support members S support the remaining walls 105*a*.

Figure 5:
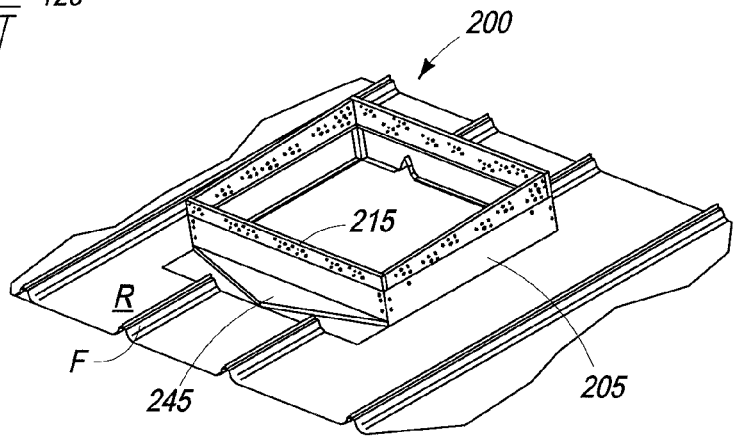
FIG. 5 is an environmental perspective view of another embodiment constructed according to principles of the invention.

Referring to FIGS. 5 and 6, another embodiment of a roof curb 200 configured according to the invention provides for diverting water that otherwise might accumulate along the upper, laterally-extending intersection of roof R and roof curb 200. The water diverting feature of roof curb 200 is intended for larger installations that would be susceptible to collecting large amounts of water. Roof curb 200 includes four walls 205 interconnected with four connection blocks 210, defining a roof curb base 212, that mounts on roof R. Four composite boards 215 mount on walls 205 and support an appliance (not shown). Roof curb 200 is similar to roof curb 100, except as described below.

As shown in FIGS. 5 and 6, unique to roof curb 200 are a diverter plate 235 and a diverter angle 245. Diverter plate 235 covers a portion of roof R removed so that ribs F in roof R do not prevent flush mounting of diverter angle 245 on roof R against roof curb 200. Like top support channel 135, diverter plate 235 has strengthening ribs 236 for supporting wall 205 and diverter angle 245.

Diverter angle 245 has upstanding flanges 247 that define an impervious dihedral angle 249. Angle 249 is such that flanges 247 provide a flow path for water to pass around roof curb 200, rather than collect against the upwardly disposed wall 205, which, over time, might cause local corrosion or sealant failures. Diverter angle 245 is sealingly connected to diverter plate 235. In operation, water flowing down roof R toward roof curb 200 would encounter then flow along flanges 247, then onto the portion of roof R lateral to roof curb 200, thereby bypassing roof curb 200 and continuing to flow down roof R.

Figure 7:
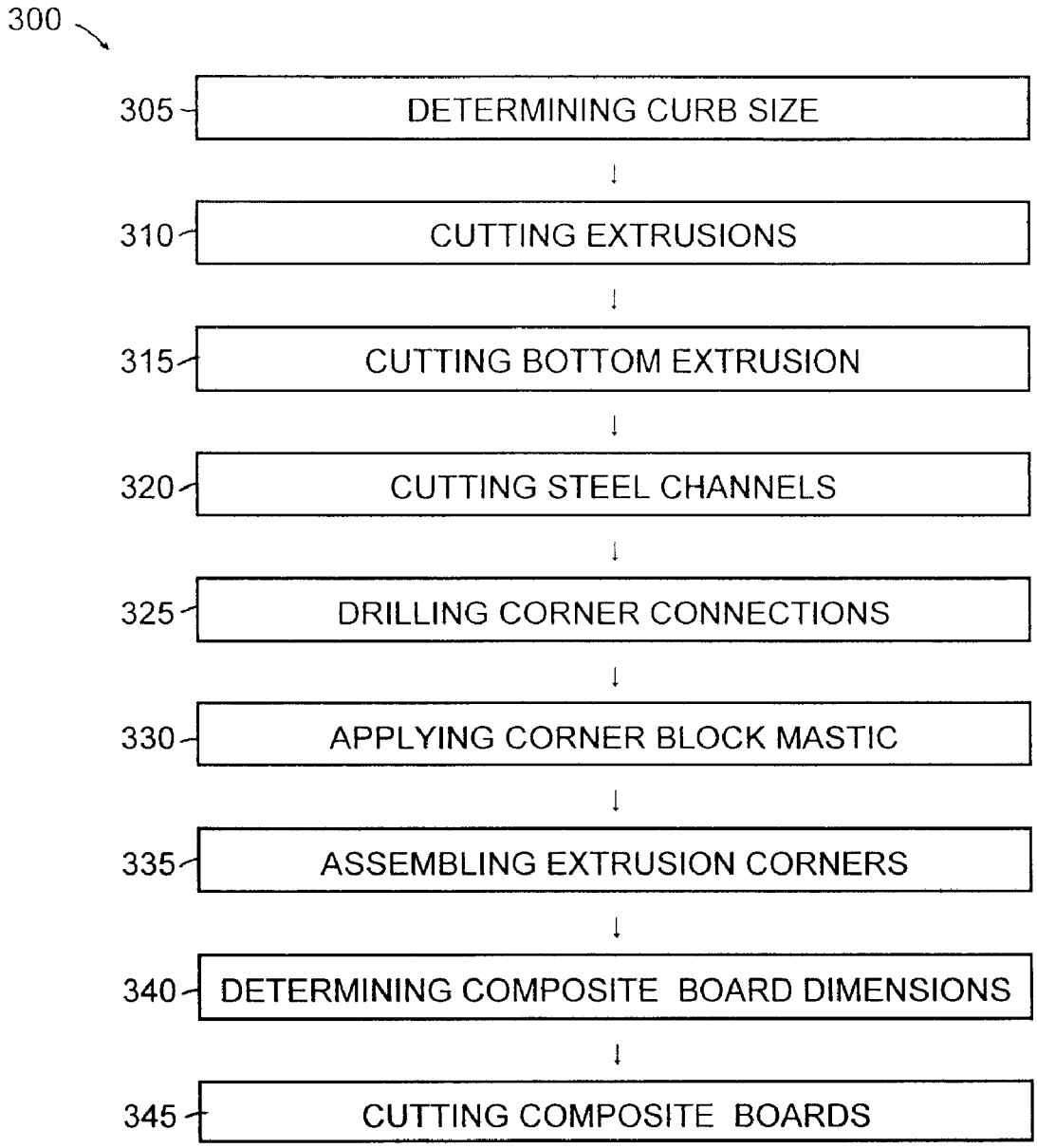
FIG. 7 is a flow chart of a method of making the embodiment of FIG. 1.

Referring to FIG. 7, an embodiment of a method of making 300 roof curb 100 configured according to the invention includes: a step 305 of determining curb size; a step 310 of cutting extrusions; a step 315 of cutting bottom extrusion; a step 320 of cutting steel channels; a step 325 of drilling corner connections; a step 330 of applying corner block mastic; a step 335 of assembling extrusion corners; a step 340 of determining composite board dimensions; and a step 345 of cutting composite boards.

Referring also to FIG. 8, step 305 involves determining a curb size to ascertain a curb length for walls 105*a*, as shown in FIG. 1, and a curb width for walls 105*b*, top support channel 135 and bottom support channel 140, as shown in FIG. 2.

Step 310 involves cutting the side extrusions or walls 105*a* according to the curb length of step 305. Preferably, a roof curb assembler uses a 12-inch compound-sliding miter-saw with a carbide tooth blade for cutting aluminum. Mitering the interfaces among walls 105 promotes relative flushness as well as flushness with respect to roof R.

Step 315 involves cutting the top and bottom extrusions or walls 105*b* according to the curb width of step 305. Step 315 differs from step 310 in that a roof curb assembler must cut walls 105*b* so as to accommodate seams or corrugations in roof R.

Step 320 involves cutting top support channel 135 and bottom support channel 140 according to the curb width of step 305. Preferably, a roof curb assembler uses an angle grinder with cutoff blade. Top support channel 135 and bottom support channel 140 also may require notching to accommodate roof support structures.

Step 325 involves aligning a template relative to and drilling pilot holes through walls 105 so as to register with through bores 112 in connection blocks 110. A roof curb assembler temporarily maintains relative positioning of the template and walls 105 with a locking C-clamp. The roof curb assembler drills two 5/16-inch diameter holes at each end of each of walls 105.

Step 330 involves applying a 5/16-inch diameter bead of gun grade sealant, preferably Panlastic, to the top, bottom and corner of each of corner blocks 110 with a caulking gun. This provides roof curbs 100 and 200 with an integral water-tight seal that is superior to post-installation sealant treatments common to other roof curbs.

Step 335 involves driving ¼-inch×½-inch phillips head bolts through the holes in walls 105 and corner connection blocks 110. Tightening the bolts urges walls 105 and corner connection blocks 110 to come together, and urges the mastic applied to corner connection blocks 110 at step 330 to flow into any gaps, thereby sealing the joint.

Step 340 involves determining the slope or pitch of roof R, and an appropriate measurement for the "X" dimension shown in FIG. 8, corresponding to the pitch so that composite boards 115 provide a generally level mounting area for an appliance (not shown). The "Y" dimension is fixed, preferably at 5-½ inches. Preferably, stock Trex® boards 115 for cutting are ¾-inch×6-inches.

Step 345 involves using a circular, table or radial-arm saw equipped with a wood-cutting carbide blade to cut stock Trex® boards 115 as required to fit tightly in channels 125.

Figure 9:
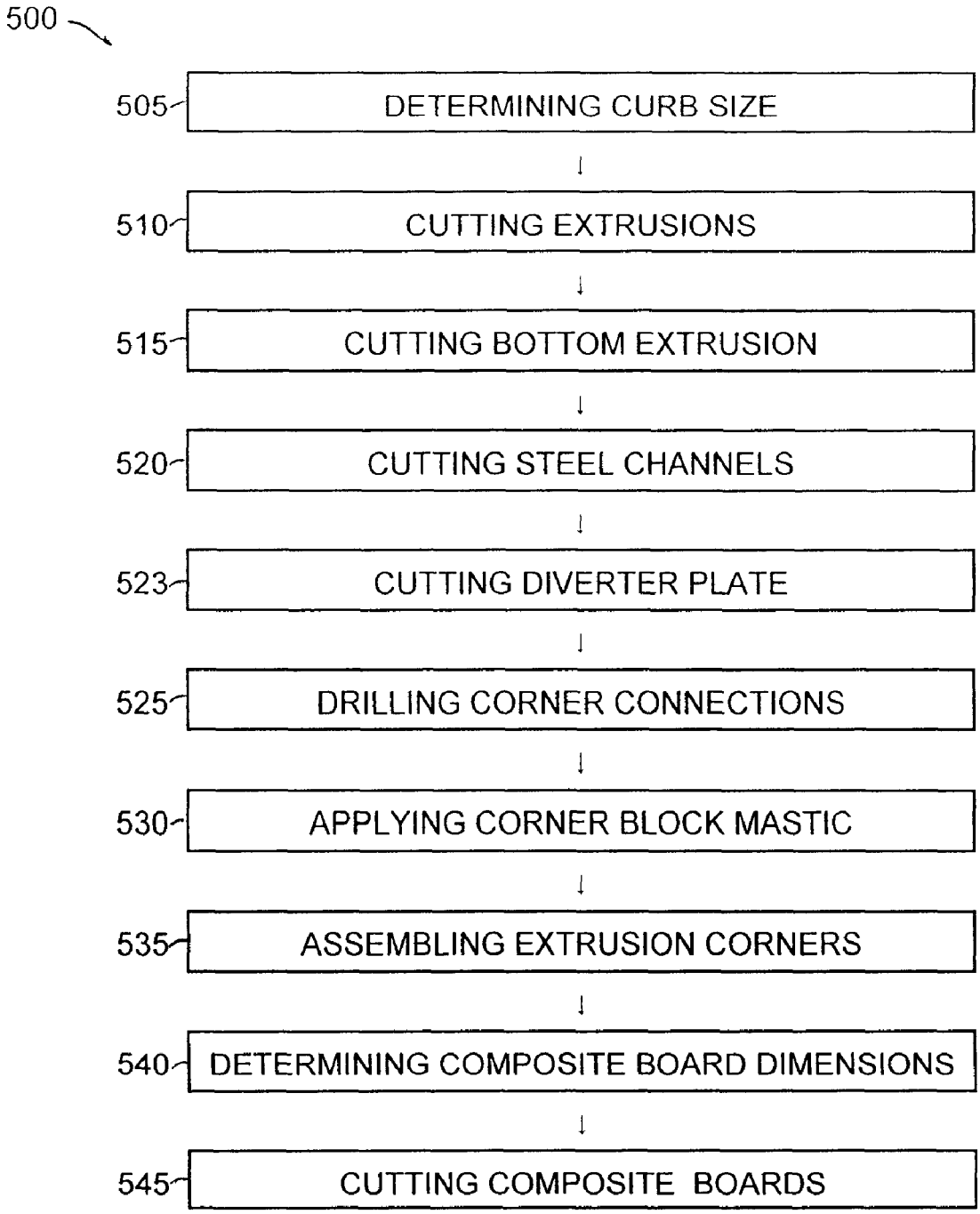
FIG. 9 is a flow chart of a method of making the embodiment of FIG. 5.

Referring to FIG. 9, an embodiment of a method of making 500 roof curb 200 configured according to the invention includes: a step 505 of determining curb size; a step 510 of cutting extrusions; a step 515 of cutting bottom extrusion; a step 520 of cutting steel channels; a step 523 of cutting diverter plate; a step 525 of drilling corner connections; a step 530 of applying corner block mastic; a step 535 of assembling extrusion corners; a step 540 of determining composite board dimensions; and a step 545 of cutting composite boards.

Figure 10:
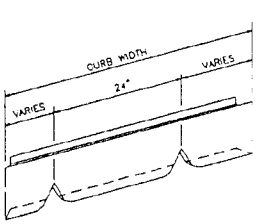
FIG. 10 is a schematic representation of the embodiment of FIG. 9.
Figure 10:
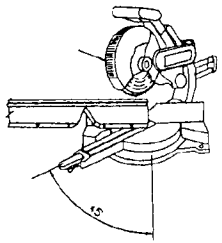
Figure 10:
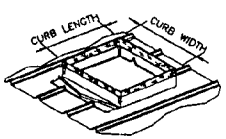
Figure 10:
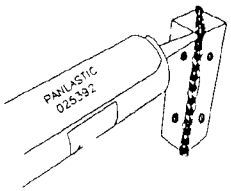
Figure 10:
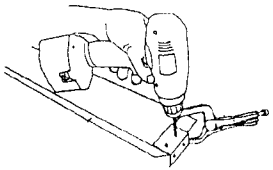
Figure 10:
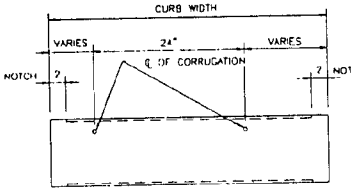
Figure 10:
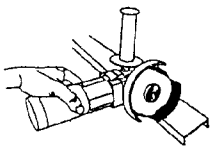
Figure 10:
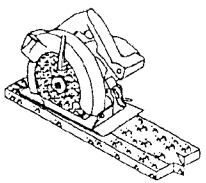
Figure 10:
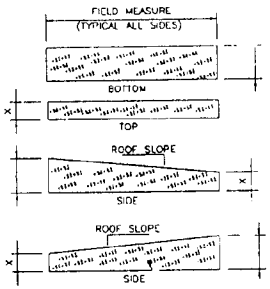
Figure 10:
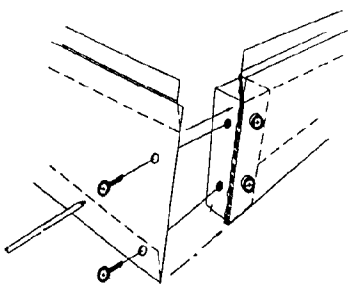

Referring also to FIG. 10, method of making 500 is substantially identical to method of making 300 except for an additional step 523. Step 523 involves cutting diverter plate 235 according to the curb width determined at step 505, which is similar to step 305. A roof curb assembler must cut diverter plate 235 so as to accommodate seams, corrugations or ribs F in roof R. Specifically, holes in diverter plate 235 must align with ribs F.

Figure 11:
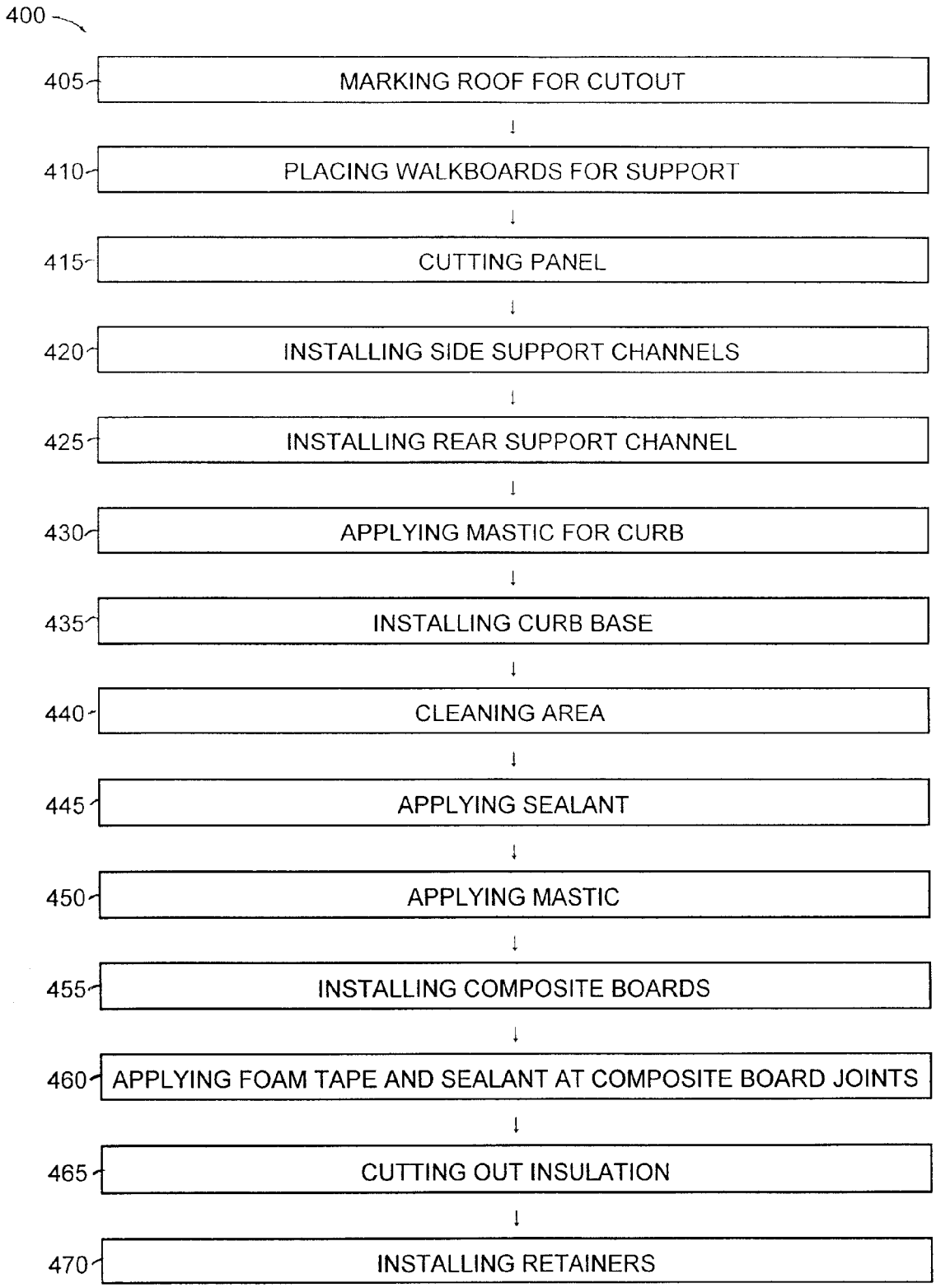
FIG. 11 is a flow chart of a method of installing the embodiment of FIG. 1.

Referring to FIG. 11, an embodiment of a method of installing 400 roof curb 100 configured according to the invention includes: a step 405 of marking roof for cutout; a step 410 of placing walkboards for support; a step 415 of cutting panel; a step 420 of installing side support channels; a step 425 of installing rear support channel; a step 430 of applying mastic for curb; a step 435 of installing curb base; a step 440 of cleaning area; a step 445 of applying sealant; a step 450 of applying mastic; a step 455 of installing composite boards; a step 460 of applying foam tape and sealant at board joints; a step 465 of cutting out insulation; and a step 470 of installing retainers.

Figure 12:
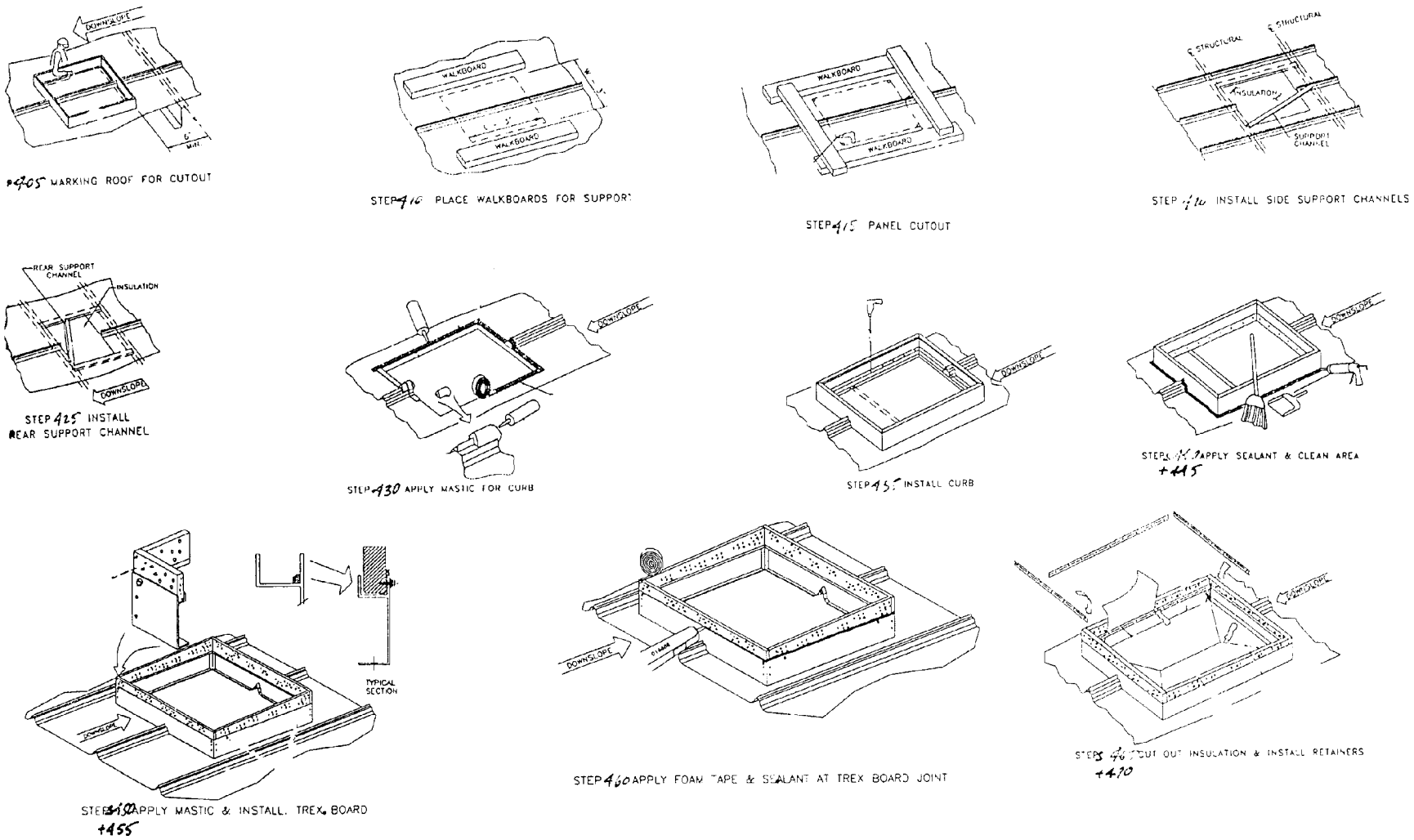
FIG. 12 is a schematic representation of the embodiment of FIG. 11.

Referring also to FIG. 12, step 405 involves placing roof curb 100, as assembled above, onto the portion of roof R where an appliance is desired. Bottom wall 105*b* should vertically register with supporting structural purlin. A minimum 6-inch distance should exist between top wall 105*b* and the upper supporting structural purlin. A roof curb installer then traces along the interior of flanges 120 of roof curb 100 with a standard lead or grease pencil.

Step 410 involves disposing boards or paneling, having sufficient strength to maintain a roof curb installer's weight on roof R, just outside of the tracing generated in step 405, proximate to where the roof curb installer will cut roof R.

Step 415 involves drilling ½-inch starter holes in roof R at each corner of the tracing of step 405, then using a double-cut shear, which minimizes shavings and chips, to cut roof R along the tracing. A roof curb installer will need a reciprocating saw to cut through corrugations in roof R.

Step 420 involves sizing and temporarily clamping in place side support channels on top of any insulation and between the upper supporting structural purlin and lower supporting structural purlin, just outside of the lateral edges of the hole in roof R generated at step 415.

Step 425 involves sizing and temporarily clamping in place a bottom support channel between the side support channels installed in step 420, just outside of the bottom edge of the hole in roof R generated at step 415.

Step 430 involves inserting lockseam plugs on the bottom corrugations occurring along the bottom edge of the hole in roof R generated at step 415. Once installed, the lockseam plugs may be filled with mastic. A roof curb installer applies ⅛-inch×½-inch Panlastic tape over the lockseam plugs around and aligned with the edges defining the hole in roof R. The tape should be butted, not lapped, at corners. Finally, the roof curb installer applies a continuous bead of sealant on top of the tape.

Step 435 involves positioning roof curb 100 over the prepared hole in roof R and securing flanges 120 of roof curb 100 to the support channels with self-drilling ¼-inch×⅞-inch metal screws at six-inch intervals.

Step 440 involves sweeping or vacuuming away all metal chips and shavings.

Step 445 involves applying a continuous bead of sealant around the intersection of roof R and roof curb 100.

Step 450 involves applying gun grade mastic in the outer corner of channels 125 of walls 105 and to the butt ends of composite boards 115.

Step 455 involves attaching composite boards 115 to walls 105 with self-drilling ¼-inch×⅞-inch metal screws, and to adjoining composite boards 115 with self-drilling #6×2-inch screws.

Step 460 involves applying sealant along the joint between walls 105 and composite boards 115. The roof curb installer then applies foam tape on the top surfaces of the composite boards 115.

Step 465 involves trimming a four-inch wide roll of insulation from building scrap. The roof curb installer places the insulation in pocket 128 in walls 105 defined by channel 125, vertical wall 127 and flange 120, as shown in FIG. 4. Temporary adhesive may aid in retaining the insulation in pocket 128. The roof curb installer then slits the building insulation from each roof curb corner inwardly, then removes the insulation from the facing. The roof curb installer folds the facing up each inner side of roof curb 100 and secures the folds thereto with retainers and self-drilling screws. The roof curb installer then tapes each corner to seal vapor retarder completely.

Figure 13:
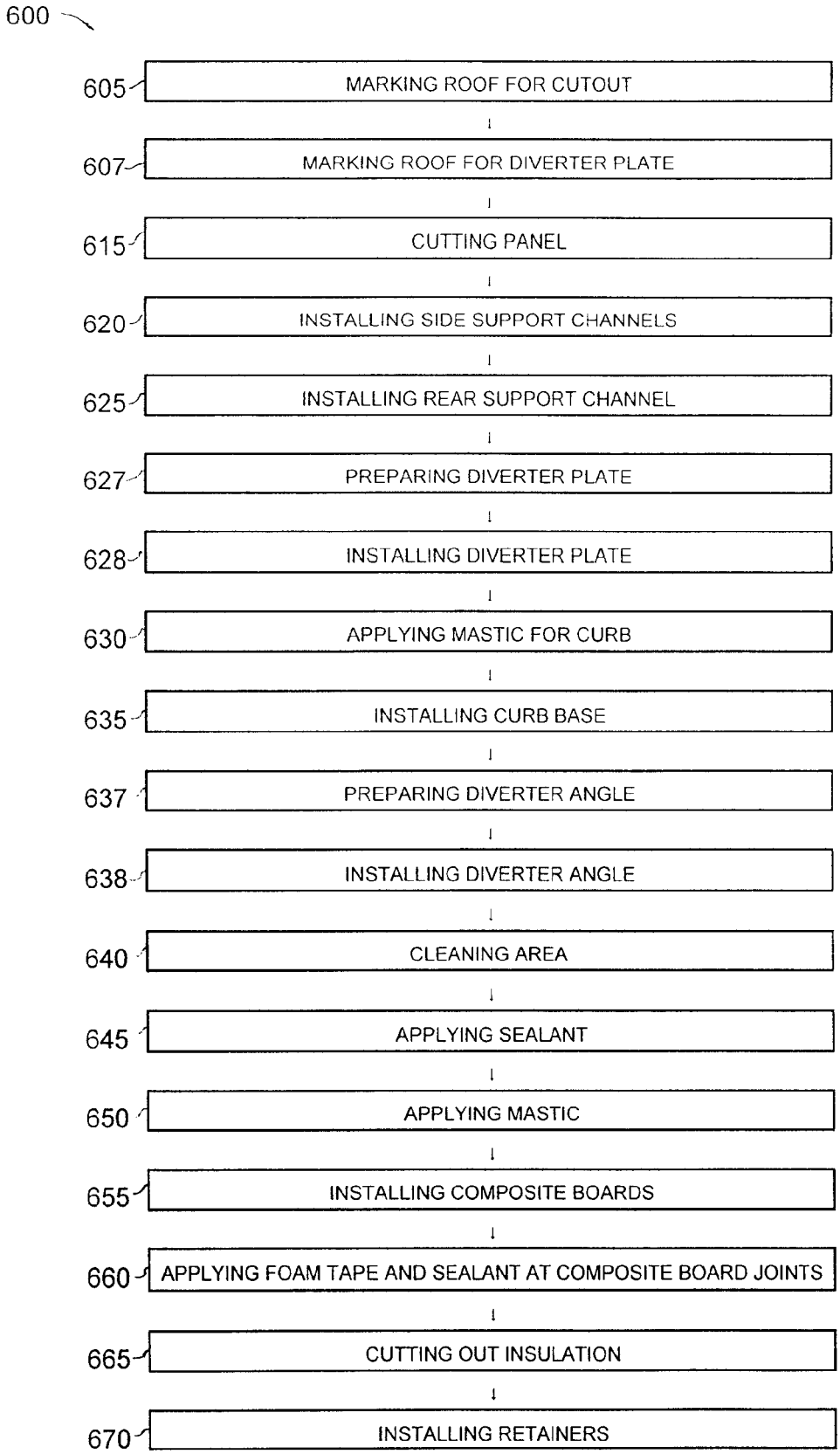
FIG. 13 is a flow chart of a method of installing the embodiment of FIG. 5.

Referring to FIG. 13, an embodiment of a method of installing 600 roof curb 200 configured according to the invention includes: a step 605 of marking roof for cutout; a step 607 of marking roof for diverter plate; a step 615 of cutting panel; a step 620 of installing side support channels; a step 625 of installing rear support channel; a step 627 of preparing diverter plate; a step 628 of installing diverter plate; a step 630 of applying mastic for curb; a step 635 of installing curb base; a step 637 of preparing diverter angle; a step 638 of installing diverter angle; a step 640 of cleaning area; a step 645 of applying sealant; a step 650 of applying mastic; a step 655 of installing composite boards; a step 660 of applying foam tape and sealant at composite board joints; a step 665 of cutting out insulation; and a step 670 of installing retainers.

Figure 14A:
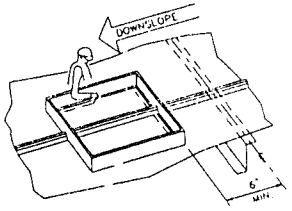
FIGS. 14*a* and 14*b* are a schematic representation of the embodiment of FIG. 13.
Figure 14A:
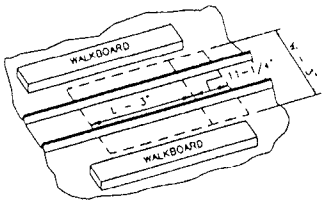
Figure 14A:
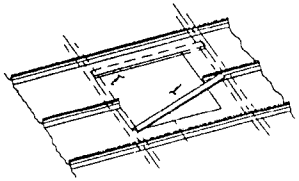
Figure 14A:
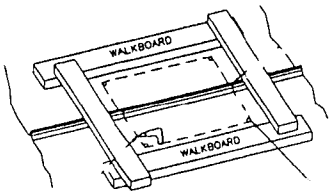
Figure 14A:
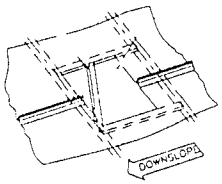
Figure 14B:
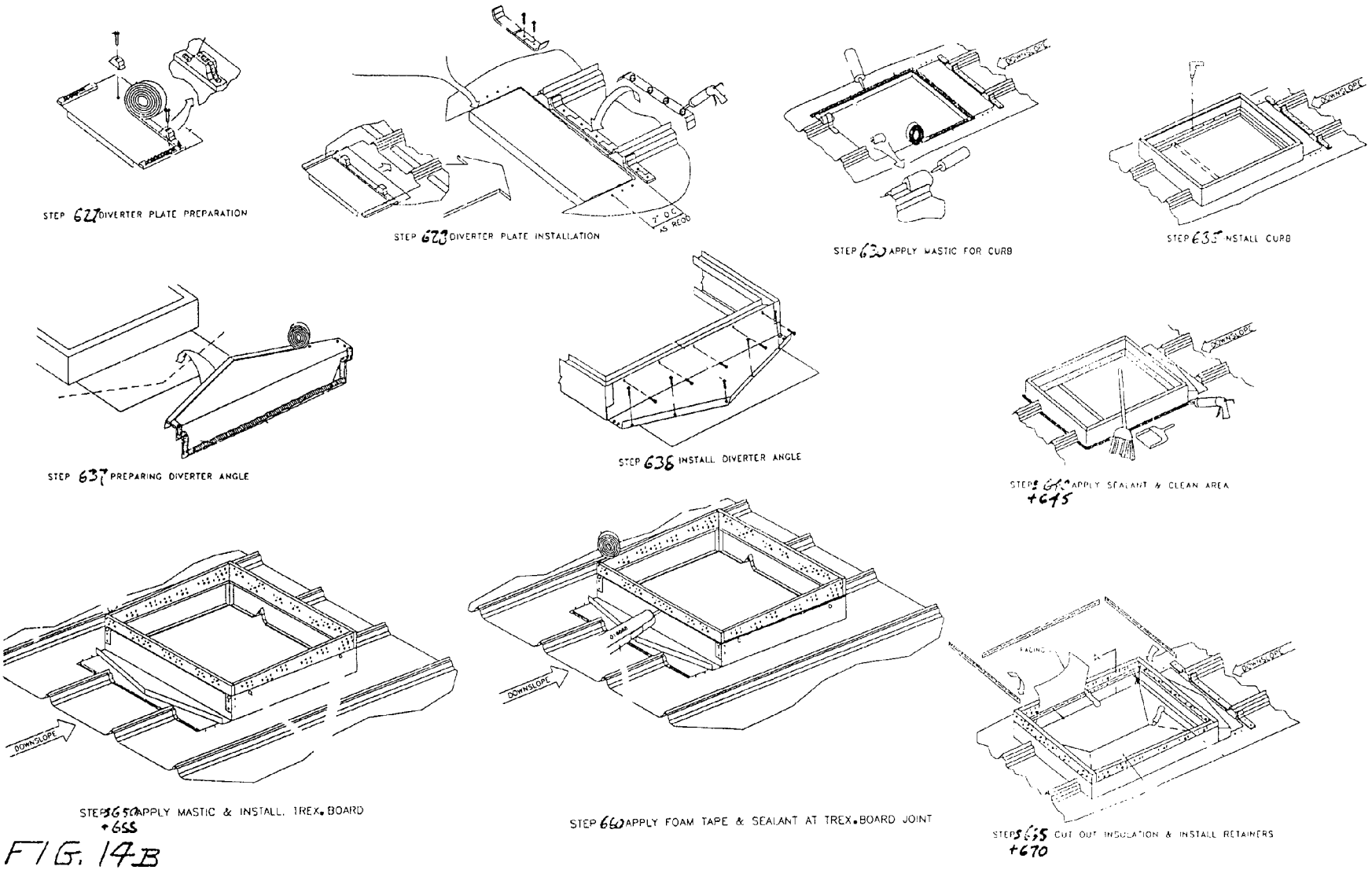

Referring also to FIGS. 14A and 14B, method of installing 600 is substantially identical to method of installing 400 except for steps 607, 627, 628, 637 and 638. Step 607 involves placing diverter plate 235 adjacent to the top edge of the tracing generated in step 605, which is similar to step 405, and tracing around diverter plate 235.

Step 627 involves attaching corrugation plugs to diverter plate 235 over the holes aligned with ribs F in roof R. The roof curb installer applies tape Panlastic over the side and outer edges of diverter plate 235, being careful to butt and not lap the ends, so that a minimum of ¼ inch is exposed around the panel cut out. The roof curb installer applies gun grade mastic over the tape Panlastic.

Step 628 involves placing diverter plate 235 in the cutout in roof R so that corrugation plugs snugly fit in the corrugations in roof R. Self-drilling threaded fasteners secure diverter plate to roof R. Mastic must be applied around holes on the bottom side of the panel strips.

Step 637 involves applying a 5/16-inch bead of mastic to the back and ⅛-inch×1½-inch tape Panlastic to bottom of diverter angle 245, then positioning diverter angle 245 against roof curb 200 on roof R.

Step 638 involves securing diverter angle 245 to roof curb 200 and roof R with self-drilling threaded fasteners.

The invention is not limited to the particular embodiments described herein, which should be understood to be merely illustrative of the invention defined by the following claims.

I claim:

1. A knock-down roof curb for supporting an appliance on a sloping roof, said roof curb comprising a plurality of metal wall members connected to form a rectangular frame having four corners which can be placed on the roof, a plurality of extension boards for extending the height of the curb, each of said wall members having an outside surface and a channel extending in from an inside surface and running along an upper edge of each of said wall members, said channel being inwardly disposed so that said outer surface remains flush with an outside surface of a particular extension board above it, said channel receiving a lower edge of each of said plurality of said extension boards and support said lower edge of each board from below while laterally containing each lower edge between two substantially vertical channel walls, the extension boards having top edges for receiving and supporting an appliance thereon, a plurality of connection blocks including bores which receive fasteners through an adjacent pair of wall member ends at each of said corners, so as to connect said frame; an opposed pair of said extension boards included in said plurality, said opposed pair being taper cut to compensate for roof slope so that said top edges provide a level surface for supporting said appliance.

2. The invention of claim 1, wherein two opposite metal wall members each have reliefs shaped to account for a roof seam of a standard size and shape.

3. The invention of claim 1, further comprising a weather seal placed between said uppermost channel and a respective extension board.

4. The invention of claim 1, further comprising a plurality of threaded fasteners passing through a side of each said channel into a respective extension board seated therein to retain the board in the channel.

5. The invention of claim 1, wherein each of said extension boards is constructed from a combination of reclaimed wood and plastic designed to reduce or eliminate rotting and splintering.

6. A method of supporting an appliance on a roof, said method comprising: providing four metal wall members and four connection blocks;

connecting said wall members by placing said connection blocks inside of adjacent wall member ends and then securing fasteners through said adjacent wall member ends into predrilled bores in said connection blocks to form a rectangular frame; defining a channel at an upper edge of all of said wall members, each channel receiving a plurality of extension boards and providing lateral containment for a bottom edge of each of said extension boards, said lateral containment created by opposing vertical faces in said channel; adapting said extension boards to be connectable to each other and to be collectively receivable by said upper edge of said frame, said extension boards being useable for the purpose of extending an overall height of said frame to provide a supporting surface for said appliance; tapering an opposed pair of said extension boards to compensate for a roof slope so that said supporting surface is level; and inwardly extending each of said channels from an inside surface atop each of said wall members so that each of said wall members is flush with a particular extension board above it.

7. The method of claim 6 comprising:

delivering said wall members and said extension members to an installation location after said producing and adapting steps have been executed.

8. The method of claim 6 comprising:

executing said producing and adapting steps at an installation location.

9. A system for supporting an appliance, said system comprising: a rectangular frame having four corners and four sides, each side comprising an outer wall, said outer wall being uniformly vertical, said frame being secured on a roof, an upper edge of said frame having an upper surface which defines a channel defined between an inside surface of said upper portion of said outer wall and an inwardly extending floor and inside wall, said channel existing on all four sides of said frame; a plurality of extension boards received into said channel, each extension board having ends, said extension boards connected to each other at said ends to create an extension of said frame upwards, said extension boards, when connected on top of said frame, providing a supporting surface for said appliance; a laterally opposed pair of said extension boards, said lateral pair being tapered in a same direction to compensate for a pitch angle of said roof such that said support surface is made to be substantially level when said system is installed; and said frame having an exterior which is flush with outer surfaces of each of said extension boards when installed.

10. The system of claim 9, wherein said frame is constructed of metal wall members, the ends of said members being connectable to form said rectangular frame.

11. The system of claim 10 wherein at least one of said metal wall members has a relief in its lower edge, the relief having a shape complementary to a roof seam of a standard size and shape, so that said one member can be placed across such a seam.

12. The system of claim 9, further comprising four connection blocks, into each of which fasteners can be driven to interconnect ends of adjacent ones of a plurality of metal wall members, so as to form said frame.

13. The system of claim 12 comprising:

a plurality of support channel members, each support member being placed on a structural roof member below a respective one of the wall members, and beneath at least one roof panel.

14. The system of claim 10 wherein each metal wall member has an uppermost channel adapted to receive a lower edge of a corresponding extension board such that said extension boards are securable atop said frame.

15. The system of claim 9 wherein a rectangular cross sectional bottom of at least one of said extension boards is received in said channel, said channel being defined such that it has a reciprocating rectangular receiving area adapted to receive and laterally stabilize said at least one of said extension boards.

16. The system of claim 9 wherein said channel laterally supports and secures a lower edge of each of said extension boards.

17. The system of claim 9 wherein said channel, when viewed in cross section, has two opposing faces which are apart an amount sufficient to allow for secured receipt of a lower edge of each of said extension boards.

* * * * *